United States Patent [19]

Pietrocini

[11] 4,277,544

[45] Jul. 7, 1981

[54] POWDER METALLURGICAL ARTICLES AND METHOD OF BONDING THE ARTICLES TO FERROUS BASE MATERIALS

[75] Inventor: Thomas W. Pietrocini, Solon, Ohio

[73] Assignee: IPM Corporation, Columbus, Ohio

[21] Appl. No.: 7,067

[22] Filed: Jan. 29, 1979

[51] Int. Cl.[3] ..... B22F 5/00

[52] U.S. Cl. ..... 428/547; 428/553; 75/208 R

[58] Field of Search ..... 75/208 R; 428/547, 553

[56] References Cited

U.S. PATENT DOCUMENTS

| | | | |
|---|---|---|---|
| 2,518,746 | 8/1950 | Blohm et al. | 428/547 |
| 2,763,519 | 9/1956 | Thomson | 428/547 |
| 3,242,562 | 3/1966 | Kraft | 29/419 |
| 3,485,331 | 12/1969 | Volker et al. | 428/547 |
| 3,717,442 | 2/1973 | Knopp | 428/553 |

*Primary Examiner*—Brooks H. Hunt

*Attorney, Agent, or Firm*—Vincent G. Gioia; William J. O'Rourke, Jr.

[57] ABSTRACT

The present invention relates to powder metal articles that can be successfully welded to ferrous base materials. A formed part having an initial part density of at least 5.8 grams per cubic centimeter subsequently compressed is to at least ninety-two per cent (92%) of theoretical full density at a controlled area, including a contact area at which the part is adapted to be welded to the other material and at least a 0.025 inch wide margin of the surface laterally contiguous the contact area to a subsurface depth of at least 0.025 inch while retaining the initial part density throughout the balance of the article. Such increased densification is accomplished by applying inwardly directed, localized surface pressure against the controlled area of a formed powder metal part.

12 Claims, No Drawings

POWDER METALLURGICAL ARTICLES AND METHOD OF BONDING THE ARTICLES TO FERROUS BASE MATERIALS

BRIEF SUMMARY OF THE INVENTION

Typically, ferrous base powder metallurgical articles are manufactured within a density range of from about 5.8 to 6.8 grams per cubic centimeter, or from about 75 to 90 percent of theoretical full (100%) density. Various applications in which such powder metal parts could be substituted for the more expensive wrought products require bonding, specifically including welding and brazing, of the parts to another ferrous base material. Such substitutions as well as various other uses of powder metal parts, have been restricted because welding and brazing of conventional powder metal parts results in weak bonds and, perhaps, part distortion. The weak bonds and part distortion are caused as a direct result of the porosity of conventional powder metal parts. In the case of welding, for example, the heat causes the powder metal part to undergo localized melting and attendant shrinkage about the weld, significantly increasing the stress on the weld. In the case of brazing, not only does the heat cause distortion, but also the expensive braze alloy is wicked away from the surface. Thus, the braze alloy must initially fill the numerous and large pores thereby prohibitively increasing the amount of braze alloy that must be employed.

Examples of industries that could employ powder metal parts in the place of wrought parts specifically include the automobile industry and the aerospace industry because of their lightweighting programs. However, it has been found that powder metal parts can be interchanged with practically all wrought parts if the metallurgical bonding of such parts may be successfully accomplished.

The present invention is directed to powder metallurgical articles that can be successfully bonded to other ferrous base materials. By the present invention a defined surface area of the power metal article, at and about the area of contact between the parts to be bonded, is compressed to at least ninety-two percent (92%) of theoretical full density. Such highly localized surface densification, at a depth of at least 0.025 inch, provides a powder metal part which may be successfully bonded to another ferrous base material. In the case of welding, the bond may be formed without experiencing excessive powder metal part shrinkage about the weld area. In the case of brazing, the bond may be formed with minimum if any distortion and with a minimum requirement for brazing alloy.

The prior art, such as Pietrocini et al. U.S. Pat. No. 3,894,678, recognizes the inability of conventional bonding applications, such as brazing and welding, to produce adequate metallurgical bonds between sintered iron articles. The solution set forth therein is to expose the articles to a preliminary treatment wherein a substantial portion of the iron is converted to $Fe_3O_4$.

Other prior art references, including Kraft U.S. Pat. No. 3,242,562, disclose the general concept of compressing a portion of parts, such as metal filaments and the like, that are to be overlapped in abutting relationship and connected to one another at the overlap. It has also been taught in the prior art, such as Wellman U.S. Pat. No. 2,451,264, that powder metal brake liners may be attached to the flange of a brake drum by compressing the liner and drum into intimate contact while simultaneously heating the assembly.

Accordingly, a new and improved method of successfully bonding powder metallurgical articles to ferrous base materials is desired to promote the successful use of less expensive, lighterweight powder-metal materials.

The present invention may be summarized as providing new and improved powder metallurgical articles that can be successfully bonded to other ferrous base materials. By the present invention a ferrous base powder metallurgical article having an initial part density of at least 5.8 grams per cubic centimeter, has a contact area at which the part is adapted to be joined to another ferrous base material. A surface portion of such article, including the contact area and at least a 0.025 inch wide margin of the surface of the article which is laterally contiguous to the contact area surface, is densified to at least ninety-two (92%) of theoretical full density to seal the interconnected porosity of the powder metallurgical material. The increased densified area extends to a subsurface depth of at least 0.025 inch while retaining the initial part density throughout the balance of the article.

In the method of the present invention a ferrous base powder metallurgical part may be joined to another ferrous base material by first compressing a ferrous base powder into a precision part having a density of at least seventy-five percent (75%) of theoretical full density. The part includes a controlled area having a contact area at which the part is adapted to be welded and a narrow margin about such contact area. After heat treating, inwardly directed, localized surface pressure is applied against the controlled area to provide at least a ninety-two percent (92%) dense area extending to a subsufaced depth of at least 0.025 inch, and, when necessary, to bring the configuration of the part within allowable final dimensional tolerance.

The primary objective of the present invention is to provide a viable method for densifying a controlled area of a powder metallurgical part at and about the area where such part is to be bonded, such as by welding or brazing, to another ferrous base part, such that the subsequent bonding operation results in an integrally bonded part exhibiting adequate strength and near elimination of dimensional variation.

Other advantages and objectives of the invention will be more thoroughly understood and appreciated with reference to the following description.

DETAILED DESCRIPTION

Ferrous base powder metallurgical parts are typically manufactured by pressing and sintering of an iron powder. Iron base powders of the present invention contain more than fifty percent (50%) iron, and may also include copper, nickel, phosphorus and various other ferrous alloying elements. By compressing the iron powders between forming dies of a press at a pressure of about thirty (30) tons per square inch and a temperature of about 2050° F. a precision part may be formed. Such parts typically exhibit an initial part density of from about 5.8 to about 6.8 grams per cubic centimeter. Since the theoretical full density of iron is about 7.6 grams per cubic centimeter, the initial part density of the precision parts is typically from seventy-five to ninety percent (75 to 90%) of theoretical full density.

It has been generally considered, such as by J. F. Hinrichs et al "Joining Sintered Steel to Wrought Steel Using Various Welding Processes," Welding Journal, June, 1971, that a powder metallurgical article should have a part density on the order of ninety-five percent (95%) of theoretical full density to withstand welding of the part and be able to perform satisfactorily in the intended service. Ideally, a part should be welded without experiencing shrinkage that would adversely affect the bond. The equipment costs to obtain excessive pressures and to use repressing procedures necessary to density an entire powder metallurgical article in excess of ninety-five percent (95%) of full density is exhorbitant and may negate the advantages of forming by powder metal techniques rather than by metal melting, casting and machining operations. In particular, the Hinrichs et al article cited above states that pressing at a pressure of 76 tons per square inch, a presintering operation, and repressing step are required to compact a one inch diameter, by two inch cylindrical powder metal part to 95% of theoretical density.

By the present invention a ferrous base powder metallurgical article is formed, as is well known, with an initial part density of from about 5.8 to 6.8 grams per cubic centimeter. Such parts are typically designed for bonding to another ferrous base part. The other ferrous base part may be a powder metallurgical article, or a wrought article in accordance with this invention.

Precision parts are typically welded to another part at a contact area. The contact area includes the surface area of the powder metallurgical article which engages a surface area of the article to which it is to be bonded. In accordance with the present invention, the density of a controlled surface area of the powder metal part at and slightly about the contact area is increased to at least about ninety-two percent (92%) of theoretical full density. It is only this surface area which must be densified in order to withstand the heat of welding without experiencing excessive part shrinkage and while still retaining the maximum advantages of using powder metal parts. Densification to ninety-two percent (92%) of theoretical density seals the interconnected porosity of the powder metal. Such sealing must be accomplished at the contact area, and at a margin, i.e. at least a 0.025 inch margin of the surface of the powder metal article which is adjacent, or laterally contiguous, the contact area. Additionally, the increased densification must extend to a minimum surface depth of 0.025 inch. Rarely, if ever should the increased densification area extend to a subsurface depth in excess of 0.250 inch, and more preferably such depth should not exceed 0.100 inch. The initial part density is retained substantially throughout the balance of the part.

Increased densification of the controlled area at and about the contact area may be accomplished by a variety of methods. The required ninety-two percent (92%) of theoretical density that must be attained at such controlled area, may be acquired by applying inwardly directed, highly localized pressure against the controlled area. Such presssure may be applied as a restriking operation in a press, after the initial strike forms the powder metal part. Typically, a pressure of sixty (60) tons per square inch is adequate to attain the increased densification of the controlled area by restriking. Another exemplary method of applying such pressure is in a roll forming operation wherein a roller is brought against the contact area. Roll forming operations are particularly suited for parts which may be mounted in a lathe and a roll may be brought thereagainst during rotation thereof. It is economically significant that such increased densification may be accomplished in cold forming operations.

It is well known that an advantage in utilizing powder metal parts is the ability to make precision parts within tight dimensional tolerance without requiring additional machining or other part dressing operations. When a subsequent densification operation is required at the contact area of a powder metal part, it is understandable that the part may be slightly compressed at such area. Since the depth of increased densification of powder metal parts in accordance with this invention is so shallow, a minimum of 0.025 inch, the compression of the part may be so slight that the part dimensions are maintained within allowable tolerance requirements. However, in certain applications, where dimensional tolerance requirements may be more strict, it may be necessary to allow for part compression in the controlled area. This may be typically accomplished by constructing the initial forming dies slightly larger in the controlled area of the part. Thus, the controlled area, including the contact surface area and at least a 0.025 inch laterally continguous margin about the contact area, is initially formed slightly larger than the desired final part dimension. It will be understood that with an initial part density of about 6 grams per cubic centimeter, an increased density in the controlled area of 7.2 grams per cubic centimeter, and a surface depth of 0.040 inch for the increased density area, only about 0.010 inch of additional powder metal material need be required to accomplish the required densification and simultaneously bring the part into final dimension. In accordance with this invention, the requirement for additional material should not exceed 0.050 inch, regardless of part size.

Typical powder metallurgical parts which can be formed by the process of the present invention include pulleys, brake flange assemblies, valve lifter bodies, gears, sprockets, clutches, pistons, hydraulic couplings, cam rings and bearings. The present invention is also applicable to the manufacture of powder metallurgical magnetic parts.

A crankshaft pulley was made in accordance with the present invention, by first pressing and sintering a ferrous base powder into a general disc shape having a central bore. The initial part density was about 6.6 grams per cubic centimeter, or 86% of theoretical full density. A mandrel was made to fit snugly through the inside diameter of the powder metal part which was formed to within 0.020 inch of the finished dimension over the outer peripheral surface contour. The part is designed to be welded at such outer peripheral surface in forming the crankshaft pulley. The powder metal part was placed in a lathe and rotated. A single roller was brought into contact against the outer peripheral surface contour of the powder metal part, which surface comprised the controlled area requiring densification in accordance with the present invention. The roller not only densified the controlled area, as required, by also compressed the part into final dimensional tolerance. Metallographic examination revealed a densification of about ninety-five percent (95%) of theoretical density in the controlled area, to a depth of about 0.040 inch. From such depth in a direction inwardly of the surface, the density diminished relatively rapidly to the initial part density throughout the remainder of the part. Such parts with increased densification in the controlled area may be welded at such controlled area to the other ferrous base materials without experiencing a change in the dimensional configuration of the part. Furthermore, the strength, toughness, crack resistance and overall integrity of the weld of such materials meets the established requirements. It will be understood that if two powder metal parts are to be welded together at a controlled area, both parts must have their respective controlled areas densified to at least ninety-two percent (92%) of theoretical density.

Controlled area densification in accordance with the present invention, as opposed to no part densification or total part densification, is less expensive, and permits substantial enjoyment of the benefits appurtenant to using powder metal parts. Furthermore, part dimensions are stabilized by this invention which shall permit the use of powder metal articles in applications having strict dimensional tolerance requirements.

What is believed to be the best mode of this invention has been described above. It will be apparent to those skilled in the art that numerous variations of the illustrated details may be made without departing from this invention.

I claim:

1. A ferrous base powder metallurgical article with an initial part density of from about 5.8 to about 6.8 grams per cubic centimeter having a controlled area, including a contact area at which the part is adapted to be bonded to another material and at least a 0.025 inch margin of the surface of the article about the contact area surface, densified to at least 92% of full density to seal the interconnected porosity of the powder metallurgical material, with the increased densified area extending to a subsurface depth of at least 0.025 inch and less than 0.250 inch, while retaining the initial part density throughout the balance of the article.

2. A powder metallurgical article as set forth in claim 1 wherein the increased densified area extends to a subsurface depth of less than 0.100 inch.

3. A ferrous base powder metallurgical article with an initial part density of from about 5.8 to about 6.8 grams per cubic centimeter having a controlled area, including a contact area at which the part is adapted to be welded to another ferrous base material and at least a 0.025 inch margin of the surface of the article about the contact ara surface, densified to at least 92% of full density to seal the interconnected porosity of the powder metallurgical material, with the increased densified area extending to a subsurface depth of at least 0.025 inch and less than 0.250 inch, while retaining the initial part density throughout the balance of the article.

4. An article as set forth in claim 3 wherein the increased densified area extends to a subsurface depth of less than 0.100 inch.

5. A method of forming a powder metallurgical part having a controlled area, including a contact area at which the part is adapted to be welded to another ferrous base material and at least a 0.025 inch surface margin laterally continguous to the contact area, comprising:

compressing a ferrous base powder into a precision part having a density of at least 75% of theoretical full density, heat treating the precision article, and subsequently applying inwardly directed localized surface pressure against the controlled area to provide at least a 92% dense surface area at the controlled area to a subsurface depth of from about 0.025 to about 0.250 inch, while substantially retaining the initial part density throughout the balance of the article.

6. A method as set forth in claim 5 wherein the inwardly directed pressure is applied in a restriking operation.

7. A method as set forth in claim 5 wherein the inwardly directed pressure is applied in a roll forming operation.

8. A method as set forth in claim 5 wherein the inwardly directed pressure is applied at room temperature.

9. A method of welding a ferrous base powder metallurgical part to a second ferrous base material comprising:

compressing a ferrous base powder into a precision part having a density of at least approximately 75% of theoretical full density, said part having a controlled area including a contact area at which the powder metal part is adapted to be welded to another part, and at least a 0.025 inch margin about the contact area, subsequently applying inwardly directed, localized surface pressure against the controlled area to provide at least 92% dense controlled area at and about the contact area to a subsurface depth of from at least 0.025 to about 0.250 inch, and welding the powder metallurgical part to the ferrous base material at the contact area.

10. A welding method as set forth in claim 9 wherein the second ferrous base material is a powder metallurgical part having the surface of its controlled area compressed to at least 92% of theoretical full density to a subsurface depth of from about at least 0.025 inch to 0.250 inch.

11. A method of welding a ferrous base powder metallurgical part to a second ferrous base material, comprising:

pressing and sintering a ferrous base powder into a precision part having an initial part density of at least approximately 75% of theoretical full density, said part having less than 0.050 inch of additional material provided at a controlled area, including a contact area at which the powder metal part is to be welded to the other part and at least a 0.025 inch margin about the contact area, subsequently, applying inwardly directed, localized surface pressure against the controlled area to provide at least 92% dense controlled area to a subsurface depth of from 0.025 to 0.250 inch, and to bring the configuration of the part within allowable final part dimensional tolerance, while retaining the initial part density throughout the balance of the powder metal part, and welding the powder metal part to the other ferrous base material at the contact area.

12. A welding method as set forth in claim 11 wherein the second ferrous base material is a powder metallurgical part having the surface of its controlled area compressed to at least 92% of theoretical full density to a depth of from about at least 0.025 inch to 0.250 inch.

* * * * *